US011028683B1

(12) United States Patent
Evitt

(10) Patent No.: US 11,028,683 B1
(45) Date of Patent: Jun. 8, 2021

(54) DOWNHOLE PUMP GAS ELIMINATING SEATING NIPPLE SYSTEM

(71) Applicant: Stoneview Solutions LLC, Williston, ND (US)

(72) Inventor: Ronald D. Evitt, Williston, ND (US)

(73) Assignee: Stoneview Solutions LLC, Williston, ND (US)

( * ) Notice: Subject to any disclaimer, the term of this patent is extended or adjusted under 35 U.S.C. 154(b) by 0 days.

(21) Appl. No.: 17/110,552

(22) Filed: Dec. 3, 2020

(51) Int. Cl.
*E21B 43/38* (2006.01)
*E21B 17/042* (2006.01)
*E21B 43/12* (2006.01)

(52) U.S. Cl.
CPC ..... *E21B 43/38* (2013.01); *E21B 17/0423* (2013.01); *E21B 43/127* (2013.01)

(58) Field of Classification Search
CPC ..... E21B 43/38; E21B 23/01; E21B 23/02; E21B 43/127; E21B 17/043
See application file for complete search history.

(56) References Cited

U.S. PATENT DOCUMENTS 3,812,911 A 5/1974 Vann
3,974,878 A 8/1976 Roeder
5,173,022 A * 12/1992 Sango ..... E21B 43/38 415/169.1
5,390,742 A 2/1995 Dines
6,113,675 A * 9/2000 Branstetter ..... B01D 19/0052 95/261
6,179,054 B1 1/2001 Stewart
6,322,616 B1 11/2001 Kennedy
7,475,731 B2 1/2009 Victor
7,980,299 B1 7/2011 Manulik
8,978,753 B2 3/2015 Ford
10,519,749 B2 12/2019 McChesney
2013/0284423 A1* 10/2013 Morrison ..... E21B 43/38 166/105.5
2016/0130921 A1 5/2016 Gronning

FOREIGN PATENT DOCUMENTS

CA 2911722 A1 5/2016

* cited by examiner

*Primary Examiner* — D. Andrews
(74) *Attorney, Agent, or Firm* — Neustel Law Offices

(57) ABSTRACT

A downhole pump gas eliminating seating nipple system for preventing and eliminating the collection of gas such as a foam barrier during operations of a downhole pump assembly. The downhole pump gas eliminating seating nipple system generally includes a seating nipple including an upper end, a lower end, and a channel extending between the upper and lower ends. The channel includes a beveled edge below the upper end and a locking lip above the lower end. A plurality of upper gas eliminators are positioned below the beveled edge. A plurality of lower gas eliminators are positioned below the locking lip. A plurality of central gas eliminators are positioned between the upper and lower gas eliminators. Each of the gas eliminators is angled upwardly from inlet to outlet so as to prevent accumulation of gasses within or below the seating nipple, which can lead to gas locking and/or gas interference.

19 Claims, 8 Drawing Sheets

DOWNHOLE PUMP GAS ELIMINATING SEATING NIPPLE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND

Field

Example embodiments in general relate to a downhole pump gas eliminating seating nipple system for preventing and eliminating the collection of gas such as a foam barrier during operations of a downhole pump assembly.

Related Art

Any discussion of the related art throughout the specification should in no way be considered as an admission that such related art is widely known or forms part of common general knowledge in the field.

Downhole pump assemblies have been used for many decades in the production or mining of various substances such as oil. Generally, a pumping jack is positioned on a ground surface above a well hole extending into the ground surface. The pumping jack is connected to a sucker rod which is drawn upwardly and downwardly to perform upstrokes and downstrokes. A plunger attached to the sucker rod functions to draw mined substances up through the well hole to be retrieved at the surface.

While downhole pump assemblies have become increasingly efficient over the years, there remains the significant risk of adverse conditions such as "gas locking" or "gas interference". Gas locking or gas interference is caused by the induction of free gas during the pumping process. Gas locking or gas interference can occur when dissolved gas that is released from the solution during the upstroke of the plunger crops up as free gas below the downhole pump's intake, within and below the seating nipple of the downhole pump. It is also acknowledged that gas locking and gas interference may occur between the valves of the downhole pump assembly. In some extreme situations, the upstroke will not have sufficient vacuum within the downhole pump assembly to reach the requisite vacuum for opening of the standing valve and allowing substances to enter the downhole pump assembly. Thus, the mined substances do not leave or enter the downhole pump, resulting in the downhole pump being "gas locked" or having a condition known as "gas interference".

Gas locking or gas interference can seriously impact the operation of the downhole pump assembly, leading to loss of production time and the requirement for costly and timely operations to release the gas lock or gas interference condition. Seating nipples which are commonly used to hold down the downhole pump assembly are particularly culpable in causing gas locking or gas interference, as conventional seating nipples have been known to allow gas to collect within or underneath the seating nipple. Such gas collection will very often lead to a gas locked or gas interfered pump.

SUMMARY

An example embodiment is directed to a downhole pump gas eliminating seating nipple system. The downhole pump gas eliminating seating nipple system includes a seating nipple including an upper end, a lower end, and a channel extending between the upper and lower ends. The channel includes a beveled edge below the upper end and a locking lip above the lower end. A plurality of upper gas eliminators are positioned below the beveled edge. A plurality of lower gas eliminators are positioned below the locking lip. A plurality of central gas eliminators are positioned between the upper and lower gas eliminators. Each of the gas eliminators are angled upwardly from inlet to outlet so as to prevent accumulation of gasses within or below the seating nipple, which can lead to gas locking or interference of a pump.

There has thus been outlined, rather broadly, some of the embodiments of the downhole pump gas eliminating seating nipple system in order that the detailed description thereof may be better understood, and in order that the present contribution to the art may be better appreciated. There are additional embodiments of the downhole pump gas eliminating seating nipple system that will be described hereinafter and that will form the subject matter of the claims appended hereto. In this respect, before explaining at least one embodiment of the downhole pump gas eliminating seating nipple system in detail, it is to be understood that the downhole pump gas eliminating seating nipple system is not limited in its application to the details of construction or to the arrangements of the components set forth in the following description or illustrated in the drawings. The downhole pump gas eliminating seating nipple system is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Figure 1:
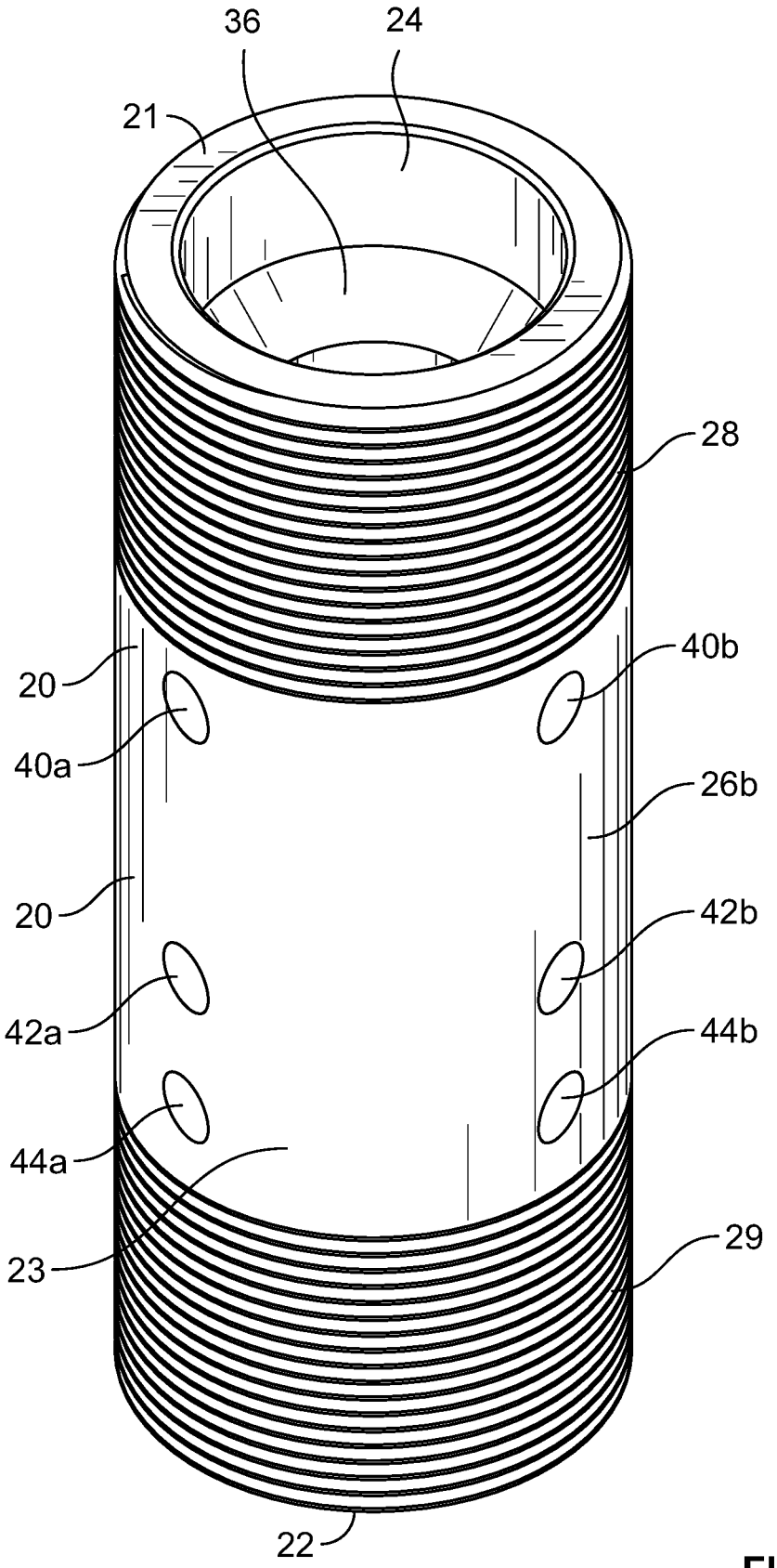
FIG. 1 is a perspective view of a seating nipple of a downhole pump gas eliminating seating nipple system in accordance with an example embodiment.

A. Overview.

An example downhole pump gas eliminating seating nipple system generally comprises a body comprising an upper end 21, a lower end 22, an upper opening 24, a lower opening 25, and an outer circumference 23. A channel 30 extends through the body between the upper opening 24 and the lower opening 25, with the channel 30 comprising an inner surface 32. A beveled edge 36 is formed on the inner surface 32 of the channel 30 below the upper end 21 of the body. A locking lip 38 is formed on the inner surface 32 of the channel 30 above the lower end 22 of the body. A plurality of upper gas eliminators 40*a*, 40*b*, 40*c*, 40*d* extend from the inner surface 32 of the channel 30 to the outer circumference 23 of the body. Each of the plurality of upper gas eliminators 40*a*, 40*b*, 40*c*, 40*d* is positioned below the beveled edge 36. Each of the plurality of upper gas eliminators 40*a*, 40*b*, 40*c*, 40*d* comprises an upper gas eliminator inlet and an upper gas eliminator outlet, with each of the plurality of upper gas eliminators 40*a*, 40*b*, 40*c*, 40*d* being angled upwardly between the upper gas eliminator inlet and the upper gas eliminator outlet.

The body may be comprised of a circular cross-section and may comprise a cylindrical shape. The plurality of upper gas eliminators 40*a*, 40*b*, 40*c*, 40*d* are comprised of a first upper gas eliminator 40*a* on a first side 26*a* of the seating nipple 20, a second upper gas eliminator 40*b* on a second side 26*b* of the seating nipple 20, a third upper gas eliminator 40*c* on a third side 26*c* of the seating nipple 20, and a fourth upper gas eliminator 40*d* on a fourth side 26*d* of the seating nipple 20. The first upper gas eliminator 40*a* is horizontally aligned with the third upper gas eliminator 40*c* and the second upper gas eliminator 40*b* is horizontally aligned with the fourth upper gas eliminator 40*d*. Each of the plurality of upper gas eliminators 40*a*, 40*b*, 40*c*, 40*d* extends upwardly at a 45 degree angle between the upper gas eliminator inlet and the upper gas eliminator outlet.

A plurality of lower gas eliminators 44*a*, 44*b*, 44*c*, 44*d* extend from the inner surface 32 of the channel 30 to the outer circumference 23 of the body. Each of the plurality of lower gas eliminators 44*a*, 44*b*, 44*c*, 44*d* are positioned below the locking lip 38. Each of the plurality of lower gas eliminators 44*a*, 44*b*, 44*c*, 44*d* comprises a lower gas eliminator inlet and a lower gas eliminator outlet. Each of the plurality of lower gas eliminators 44*a*, 44*b*, 44*c*, 44*d* is angled upwardly between the lower gas eliminator inlet and the lower gas eliminator outlet. Each of the plurality of lower gas eliminators 44*a*, 44*b*, 44*c*, 44*d* is vertically aligned with one of the plurality of upper gas eliminators 40*a*, 40*b*, 40*c*, 40*d*.

The plurality of lower gas eliminators 44*a*, 44*b*, 44*c*, 44*d* are comprised of a first lower gas eliminator 44*a* on a first side 26*a* of the seating nipple 20, a second lower gas eliminator 44*b* on a second side 26*b* of the seating nipple 20, a third lower gas eliminator 44*c* on a third side 26*c* of the seating nipple 20, and a fourth lower gas eliminator 44*d* on a fourth side 26*d* of the seating nipple 20. The first lower gas eliminator 44*a* is horizontally aligned with the third lower gas eliminator 44*c* and the second lower gas eliminator 44*b* is horizontally aligned with the fourth lower gas eliminator 44*d*. Each of the plurality of lower gas eliminators 44*a*, 44*b*, 44*c*, 44*d* extends upwardly at a 45 degree angle between the lower gas eliminator inlet and the lower gas eliminator outlet.

A plurality of central gas eliminators 42*a*, 42*b*, 42*c*, 42*d* extend from the inner surface 32 of the channel 30 to the outer circumference 23 of the body. Each of the plurality of lower gas eliminators 42*a*, 42*b*, 42*c*, 42*d* are positioned between the locking lip 38 and the plurality of upper gas eliminators 40*a*, 40*b*, 40*c*, 40*d*. Each of the plurality of central gas eliminators 42*a*, 42*b*, 42*c*, 42*d* comprises a central gas eliminator inlet and a central gas eliminator outlet. Each of the plurality of central gas eliminators 42*a*, 42*b*, 42*c*, 42*d* is angled upwardly between the central gas eliminator inlet and the central gas eliminator outlet.

Each of the plurality of central gas eliminators 42*a*, 42*b*, 42*c*, 42*d* is vertically aligned with one of the plurality of upper gas eliminators 40*a*, 40*b*, 40*c*, 40*d* and one of the plurality of lower gas eliminators 44*a*, 44*b*, 44*c*, 44*d*. The plurality of central gas eliminators 42*a*, 42*b*, 42*c*, 42*d* are comprised of a first central gas eliminator 42*a* on a first side 26*a* of the seating nipple 20, a second central gas eliminator 42*b* on a second side 26*b* of the seating nipple 20, a third central gas eliminator 42*c* on a third side 26*c* of the seating nipple 20, and a fourth central gas eliminator 42*d* on a fourth side 26*d* of the seating nipple 20. The first central gas eliminator 42*a* is horizontally aligned with the third central gas eliminator 42*c* and the second central gas eliminator 42*b* is horizontally aligned with the fourth central gas eliminator 42*d*. Each of the plurality of central gas eliminators 42*a*, 42*b*, 42*c*, 42*d* extends upwardly at a 45 degree angle between the central gas eliminator inlet and the central gas eliminator outlet.

Figure 8:
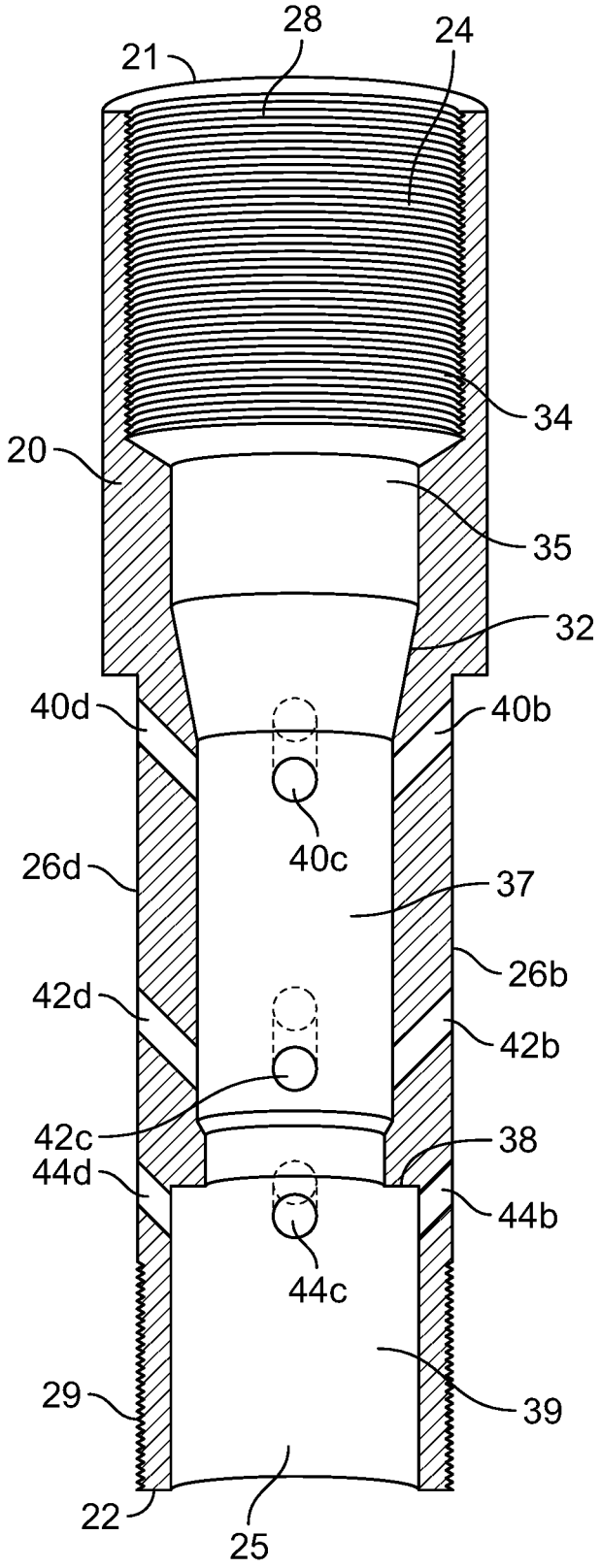
FIG. 8 is a sectional view of a seating nipple with female-male connectors of a downhole pump gas eliminating seating nipple system in accordance with an example embodiment.

The upper end 21 of the body comprises an upper connector 28 and the lower end 22 of the body comprises a lower connector 29. The upper connector 28 and the lower connector 29 are each comprised of a threaded connector. The upper connector 28 may be comprised of a male or female threaded connector and the lower connector 29 may be comprised of a male or female threaded connector such as shown in FIG. 8. This gas eliminating seating nipple 20 can be comprised of any combination of threaded ends, male or female, or any style of quick connections or any other combination of "on/off tools".

B. Seating Nipple.

As shown throughout the figures, the downhole pump gas eliminating seating nipple system includes a seating nipple 20 which is utilized to hold or maintain a downhole pump assembly 50 in place as a sucker rod 52 moves a plunger 53 inside of the downhole pump assembly 50 to produce various mined substances such as oil, gas, and water. The use of the systems and methods described herein may result in significant increases in downhole pump efficiencies by decreasing gas locking or gas interference hindrances. As shown throughout the figures, the seating nipple 20 will generally comprise a mechanical seating nipple 20 which is configured to prevent gasses 56 from being trapped inside, or below, the seating nipple 20. The collection of such gasses 56, particularly inside the seating nipple 20, can considerably hinder the operation of a downhole pump assembly 50.

FIGS. 1-8 illustrate an exemplary embodiment of a seating nipple 20. As best shown in FIG. 1, the seating nipple 20 will generally comprise a cylindrical body including an upper end 21, a lower end 22, and an outer circumference 23. While the figures illustrate the seating nipple 20 as comprising a straight cylindrical body or tube, it should be appreciated that various other shapes may be utilized in some embodiments. By way of example, in some embodiments, the seating nipple 20 may not comprise a uniform diameter for its entire length between its upper and lower ends 21, 22. In some embodiments, the diameter of the seating nipple 20 may vary at different portions along its length. It should also be appreciated that, while the figures illustrate a seating nipple 20 having a circular cross-section, various other cross-sections could be utilized in different embodiments. This can be further described in, and has been used in, various wellbore centering designs known in oil and gas mining operations.

It should also be appreciated that the dimensions of the seating nipple 20 may vary in different embodiments to suit different types and sizes of downhole pump assemblies 50. For example, the length of the seating nipple 20, defined as the distance between its upper end 21 and its lower end 22, may vary in different embodiments to suit different downhole pump assemblies 50. Further, the diameter of the seating nipple 20 may vary in different embodiments to suit different downhole pump assemblies 50. Additionally, the diameter of the upper and lower openings 24, 25, as well as the diameter of the channel 30 extending through the interior of the seating nipple 20, may vary in different embodiments to suit different downhole pump assemblies 50. Thus, the scope should not be construed as limited to the particular dimensions shown in the exemplary figures.

The seating nipple 20 may be comprised of various materials, but will generally be comprised of various types of metals or metal alloys. However, in some embodiments, certain plastics may be utilized for the seating nipple 20. Thus, the scope should not be construed as limited to any particular type of material. In a preferred embodiment, the seating nipple 20 may be comprised of stainless steel, such as 316, or 304, stainless steel. In other embodiments, the seating nipple 20 may be comprised of materials such as carbon steel, titanium, or other metals/metal alloys.

The seating nipple 20 may be comprised of a single, unitary, integral member of a single type of material. In other embodiments, the seating nipple 20 may be comprised of discrete, interconnected members. In such embodiments, the seating nipple 20 may comprise multiple material types rather than being uniformly comprised of a single material such as stainless steel.

Figure 4:
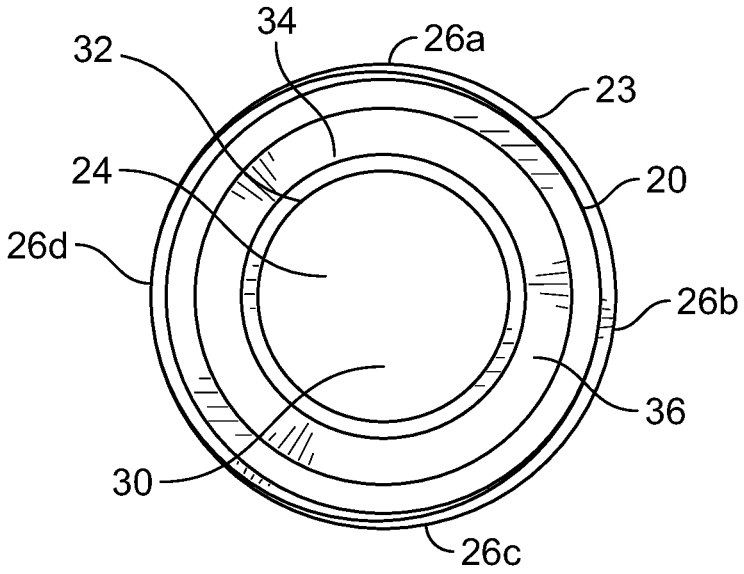
FIG. 4 is a top view of a seating nipple of a downhole pump gas eliminating seating nipple system in accordance with an example embodiment.
Figure 5:
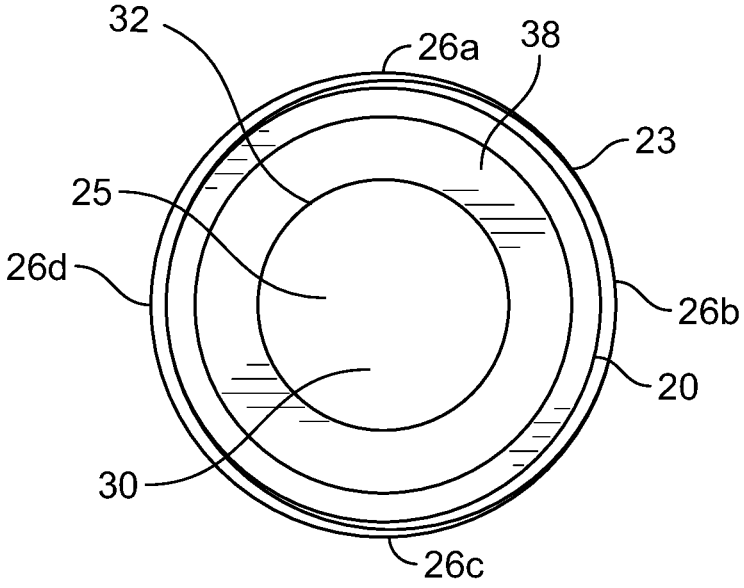
FIG. 5 is a bottom view of a seating nipple of a downhole pump gas eliminating seating nipple system in accordance with an example embodiment.

With reference to FIGS. 1 and 4, it can be seen that the upper end 21 of the seating nipple 20 includes an upper opening 24 and that the lower end 22 of the seating nipple 20 includes a lower opening 25. Mined substances such as oil, gas, and water are drawn into the seating nipple 20 through the lower opening 25. The mined substances then pass through the length of the seating nipple 20, with any gasses being expelled through the gas eliminators 40*a*, 40*b*, 40*c*, 40*d*, 42*a*, 42*b*, 42*c*, 42*d*, 44*a*, 44*b*, 44*c*, 44*d*. The mined substances are then drawn through the upper opening 24 of the seating nipple 20.

As best shown in FIGS. 2-5, the seating nipple 20 has been identified as including a first side 26*a*, a second side 26*b*, a third side 26*c*, and a fourth side 26*d*, with each side 26*a*, 26*b*, 26*c*, 26*d* representing a ninety-degree arc along the outer circumference 23 of the seating nipple 20. The identification of discrete sides 26*a*, 26*b*, 26*c*, 26*d* of the cylindrical seating nipple 20 is useful in identifying the respective location of each of the gas eliminators 40*a*, 40*b*, 40*c*, 40*d*, 42*a*, 42*b*, 42*c*, 42*d*, 44*a*, 44*b*, 44*c*, 44*d*. Thus, identification of any particular side 26*a*, 26*b*, 26*c*, 26*d* of the seating nipple 20 should be understood as representing one of the four discrete 90 degree arcs formed along the outer circumference 23 of the seating nipple 20 which sum up to a complete 360 degree circle defining the outer circumference 23 of the seating nipple 20.

Figure 2:
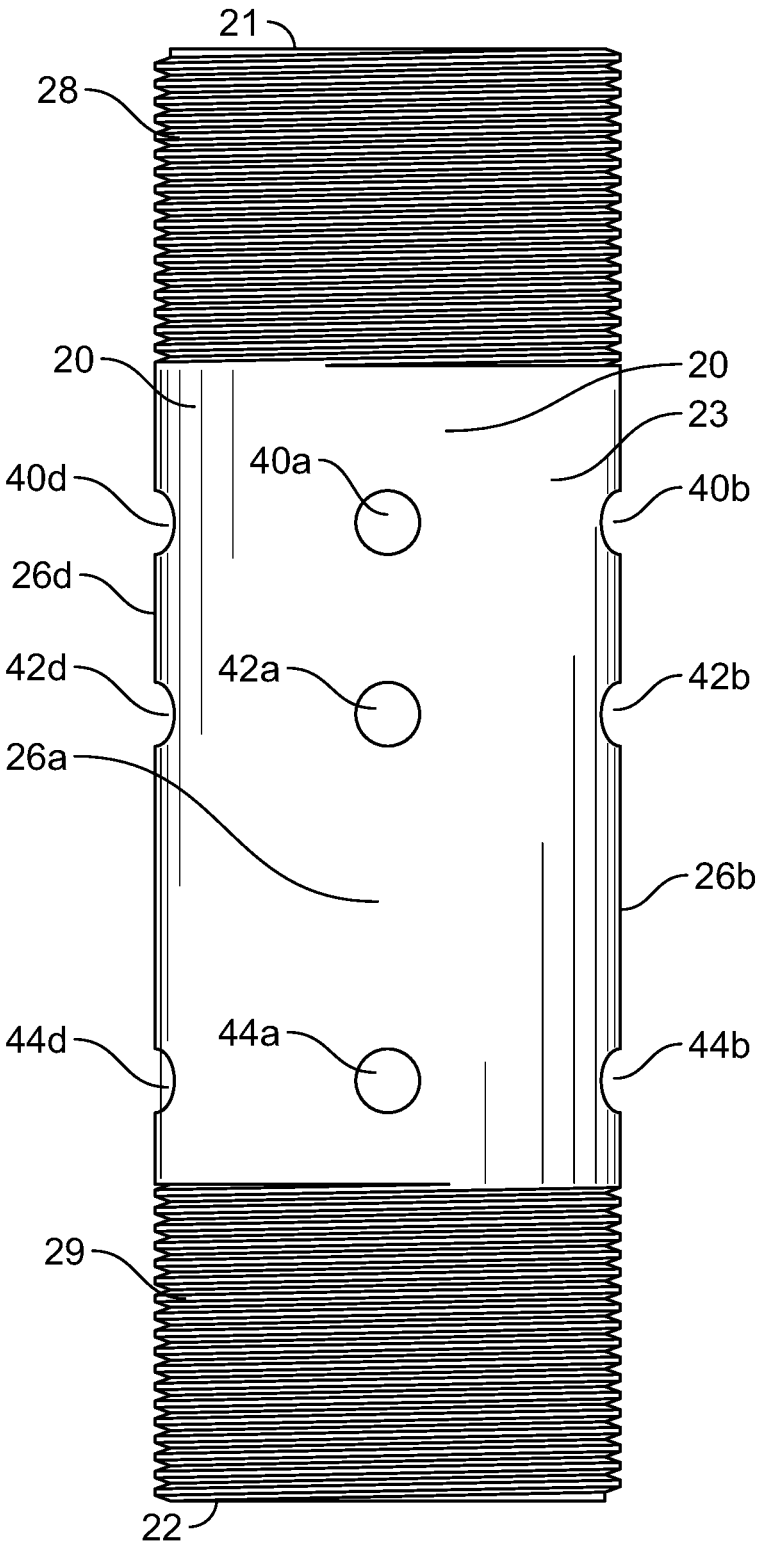
FIG. 2 is a frontal view of a seating nipple of a downhole pump gas eliminating seating nipple system in accordance with an example embodiment.
Figure 3:
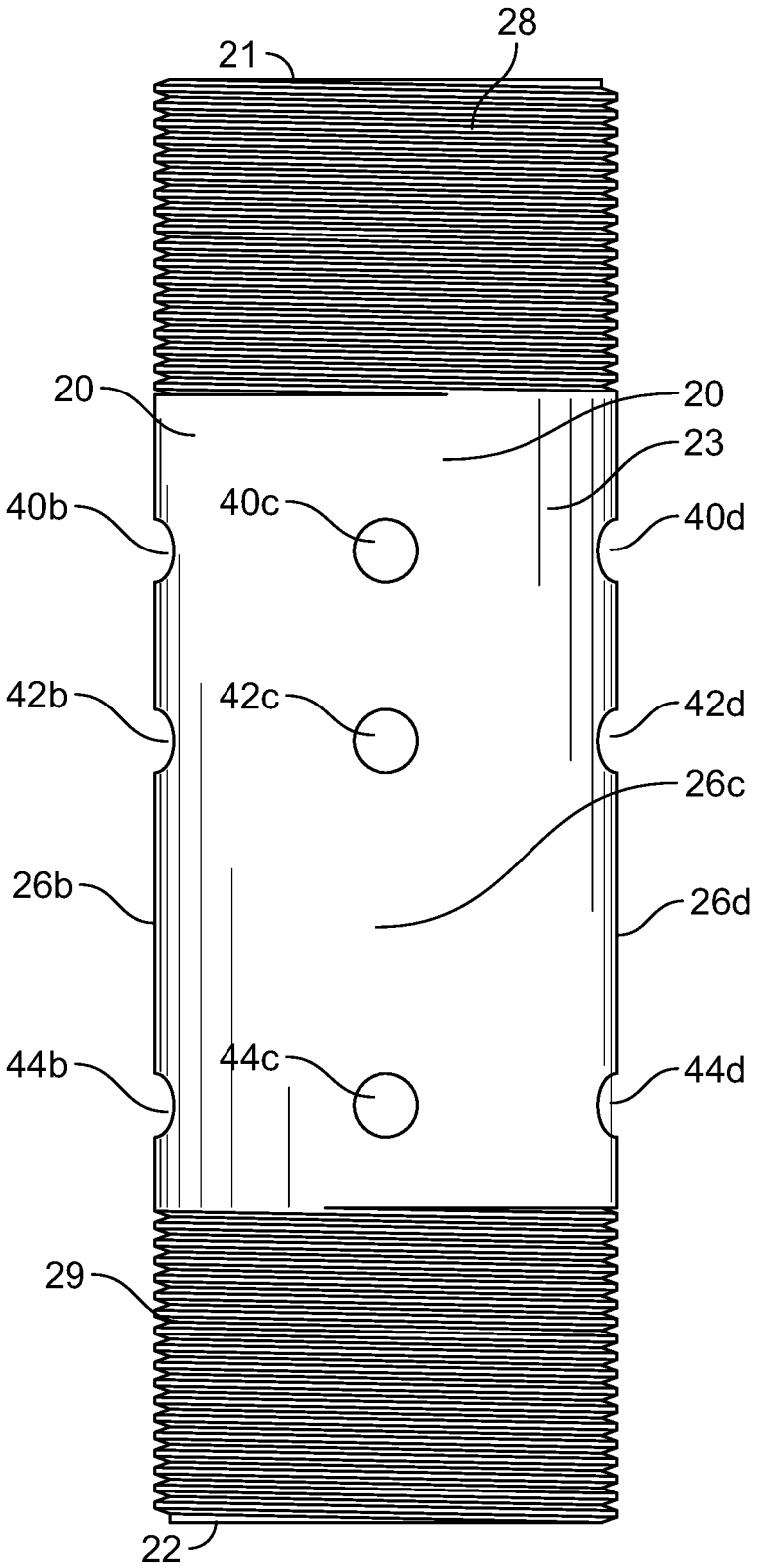
FIG. 3 is a rear view of a seating nipple of a downhole pump gas eliminating seating nipple system in accordance with an example embodiment.
Figure 7:
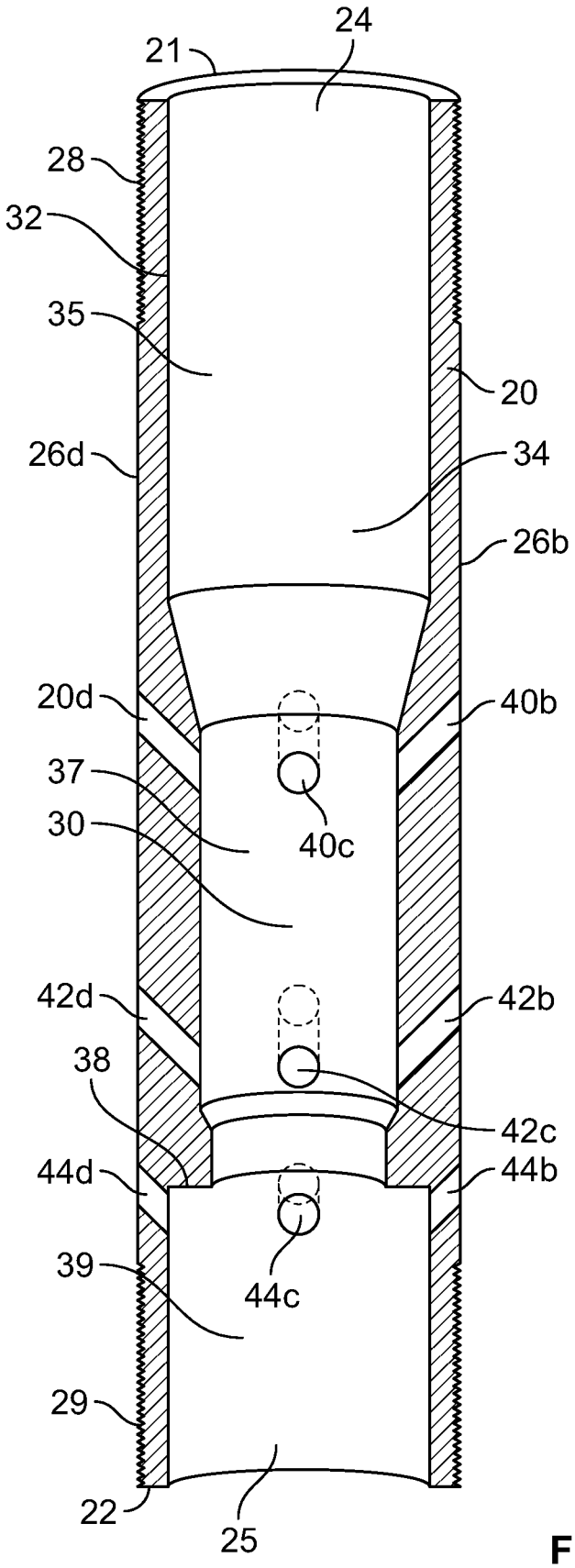
FIG. 7 is a sectional view of a seating nipple with male-male connectors of a downhole pump gas eliminating seating nipple system in accordance with an example embodiment.

As shown in FIGS. 1-3, the seating nipple 20 may include an upper connector 28 positioned at or near the upper end 21 of the seating nipple 20. The upper connector 28 will generally comprise a threaded connector which is adapted to engage with other components of the downhole pump assembly 50. However, other connection types may be utilized, such as brackets, fasteners, and the like. Where a threaded connection type is utilized, the upper connector 28 may comprise either a male threaded connection or a female threaded connection. FIG. 7 illustrates an embodiment in which the upper connector 28 is comprised of a male threaded connection. FIG. 8 illustrates an embodiment in which the upper connector 28 is comprised of a female threaded connection.

Continuing to reference FIGS. 1-3, it can be seen that the seating nipple 20 may also include a lower connector 29 positioned at or near the lower end 22 of the seating nipple 20. The lower connector 29 will generally comprise a threaded connector which is adapted to engage with other components of the downhole pump assembly 50. However, other connection types may be utilized, such as brackets, fasteners, and the like. Where a threaded connection type is utilized, the lower connector 29 may comprise either a male threaded connection or a female threaded connection. FIG. 7 illustrates an embodiment in which the lower connector 29 is comprised of a male threaded connection. Although not shown, the lower connector 29 may also comprise a female threaded connection in certain embodiments.

The length of the upper and lower connectors 28, 29 as a ratio to the overall length of the seating nipple 20 (defined as the distance between its upper and lower ends 21, 22) may vary in different embodiments. Thus, the respective lengths of the upper and lower connectors 28, 29 may vary in different embodiments. In the exemplary embodiment best shown in FIG. 1, the upper connector 28 is illustrated as comprising approximately ¼ of the length of the seating nipple 20. Similarly, the lower connector 29 is illustrated as comprising approximately ¼ of the length of the seating nipple 20. These dimensions are merely for exemplary purposes and should not be construed as limiting in scope. Further, although the figures illustrate that the upper and lower connectors 28, 29 are the same size, it should be appreciated that the upper and lower connectors 28, 29 may comprise different sizes in some embodiments (e.g., the upper connector 28 may be longer or shorter than the lower connector 29).

Figure 6:
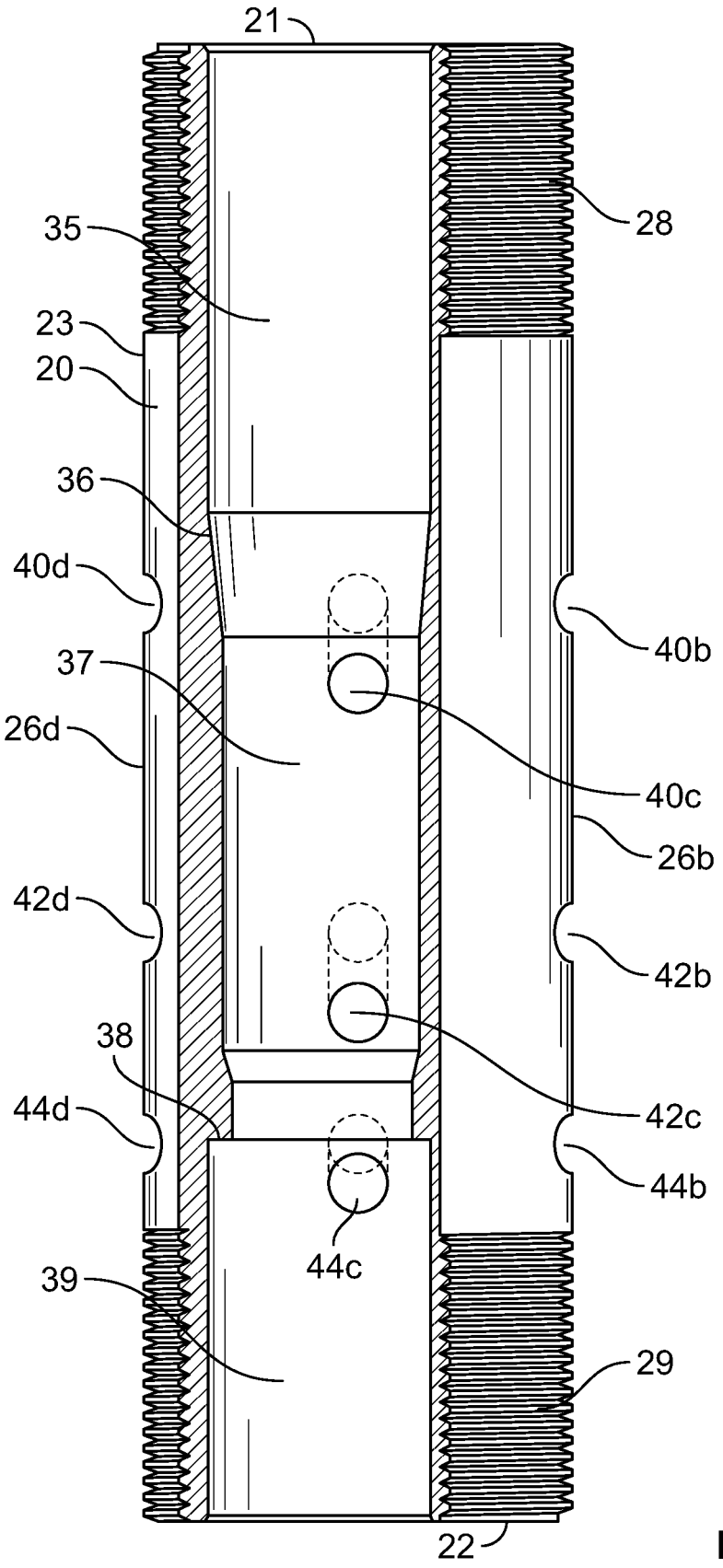
FIG. 6 is a cutaway view of a seating nipple with male-male connectors of a downhole pump gas eliminating seating nipple system in accordance with an example embodiment.

As best shown in FIGS. 6-8, a channel 30 extends through the seating nipple 20 between its upper opening 24 and its lower opening 25. Generally, the channel 30 will continuously extend through the entire length of the seating nipple 20 from its upper end 21 to its lower end 22 without any breaks. As discussed herein, however, the effective width or diameter of the channel 30 may vary at different locations along the length of the seating nipple 20.

The channel 30 is defined by an inner surface 32 such as shown in FIG. 6. In the embodiment best shown in FIG. 6, it can be seen that the channel 30 has been identified by three discrete but interconnected and continuous portions: an upper portion 35, a central portion 37, and a lower portion 39. The upper portion 35 of the channel 30 extends downwardly from the upper end 21 of the seating nipple 20. The lower portion 39 of the channel 30 extends upwardly from the lower end 22 of the seating nipple 20. The central portion 37 of the channel 30 is positioned between the upper and lower portions 35, 39 of the channel 30. The respective lengths and widths or diameters of each respective portion 35, 37, 39 may vary in different embodiments and should not be construed as limited by the exemplary embodiments shown in the figures.

As best shown in FIGS. 4 and 6, the upper portion 35 of the channel 30 of the seating nipple 20 may include a bore opening 34 which is continuous with the upper opening 24 of the seating nipple 20. The bore opening 34 may be defined by a beveled edge 36 which is slightly offset with respect to the upper opening 24 of the seating nipple 20.

The beveled edge 36 is best shown in FIGS. 4 and 6 as comprising an angled or tapered surface which effectively reduces the overall width or diameter of the channel 30 near the upper end 21 of the seating nipple 20. The angle of the beveled edge 36, as well as its length and width, may vary in different embodiments and should not be construed as limited by the exemplary embodiments shown in the figures.

Figure 9:
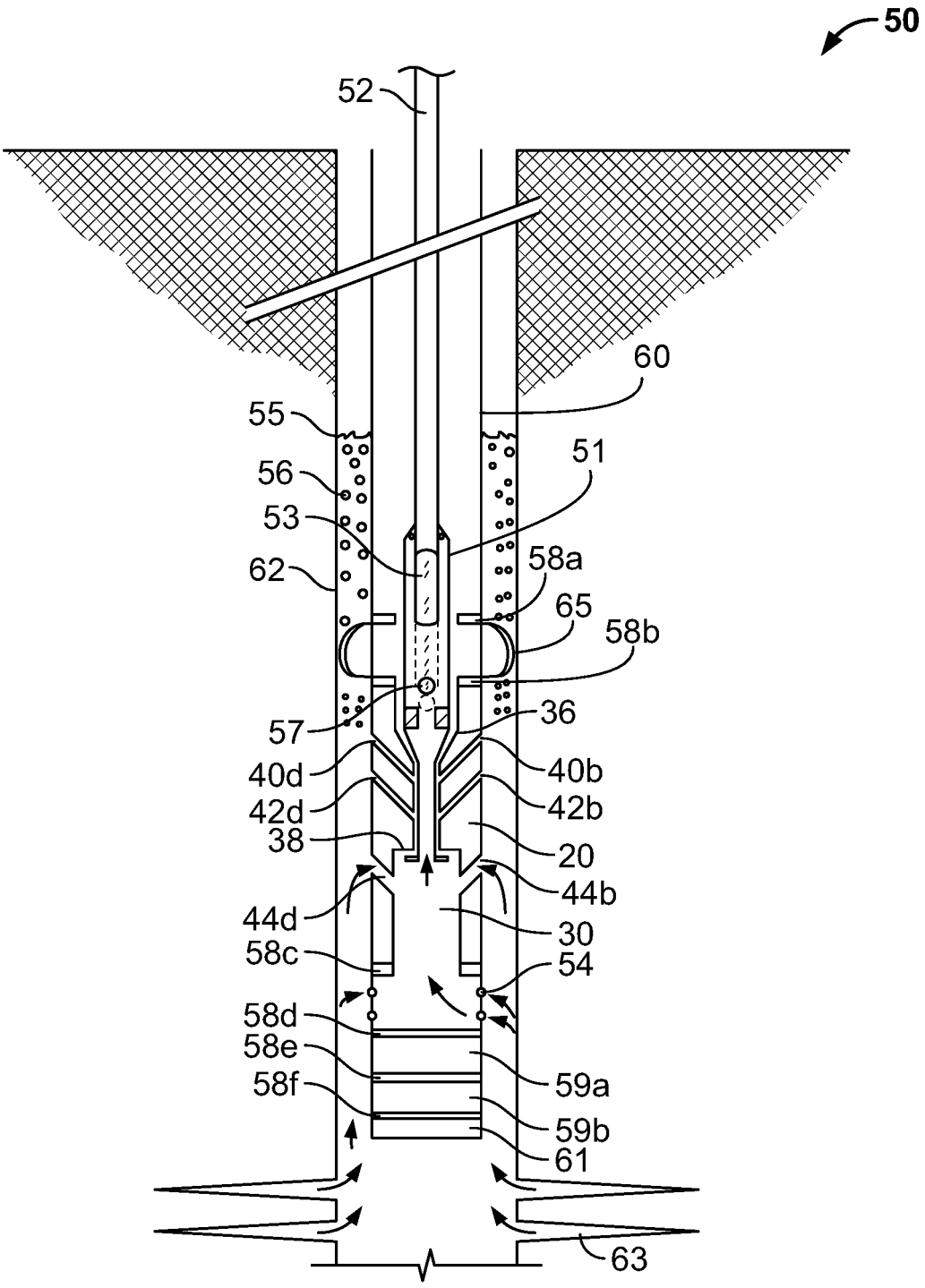
FIG. 9 is a sectional view of a downhole pump gas eliminating seating nipple system in accordance with an example embodiment.

The beveled edge 36 is adapted to serve as a seal or pump seat for the downhole pump assembly 50. In a typical downhole pump assembly 50, the pump seal ring of the downhole pump assembly 50 matches up to the seating nipple 20 at the beveled edge 36, which functions as a seal. Thus, the beveled edge 36 may function as a standard mechanical hold down bevel when the seating nipple 20 is installed as part of a downhole pump assembly 50. FIG. 9 illustrates a downhole pump assembly 50 and illustrates the positioning of the seal ring of the downhole pump assembly 50 with respect to the beveled edge 36 of the seating nipple 20.

As best shown in FIGS. 4 and 6, the beveled edge 36 functions to reduce the overall width or diameter of the channel 30 between the upper portion 35 of the channel 30 and the central portion 37 of the channel 30. Thus, in the embodiment shown in the figures, the width or diameter of the upper portion 35 of the channel 30 is greater than the width or diameter of the central portion 37 of the channel 30, with the width or diameter being effectively reduced by operation of the beveled edge 36.

As shown in FIG. 6, the central portion 37 of the channel 30 of the seating nipple 20 begins at the beveled edge 36 and extends downwardly until transitioning into the lower portion 39 of the channel 30 at the locking lip 38. As discussed below, the upper and central gas eliminators 40*a*, 40*b*, 40*c*, 40*d*, 42*a*, 42*b*, 42*c*, 42*d* extend out of the central portion 37 of the channel 30.

In the embodiment shown in the figures, it can be seen that the central portion 37 of the channel 30 is of a smaller width or diameter than the upper and lower portions 35, 39 of the channel 30. The width or diameter of the channel 30 is thus reduced between the upper and central portions 35, 37 of the channel 30, and then increased between the central and lower portions 37, 39 of the channel 30.

As best shown in FIG. 6, it can be seen that the channel 30 includes a lower portion 39 which is concentric with respect to the central portion 37 of the channel 30. The lower portion 39 will generally include a greater width or diameter than the central portion 37 of the channel 30, with the width or diameter being enlarged between the central portion 37 and the lower portion 39. The upper and lower portions 35, 39 of the channel 30 may have the same diameter or width, or may have different diameters or widths.

Continuing to reference FIG. 6, it can be seen that the seating nipple 20 includes a locking lip 38 positioned at the transition between the central and lower portions 37, 39 of the channel 30. The locking lip 38 may comprise a ledge which functions as a latch to secure a mechanical hold down style sucker rod 52 operated as part of a downhole pump assembly 50. The locking lip 38 may comprise a ledge which is perpendicular with respect to the inner surface 32 of the channel 30 and which extends transversely (e.g., perpendicularly) with respect to an axis extending between the upper and lower ends 21, 22 of the seating nipple 20.

The shape and size of the locking lip 38 may vary in different embodiments and thus should not be construed as limited by the exemplary figures. The locking lip 38 will generally comprise a ring member which extends for the entire circumference of the inner surface 32 of the channel 30, extending into the channel 30 a distance. The distance by which the lip 38 extends into the channel 30 from the inner surface 32 thereof may vary in different embodiments to suit different types of downhole pump assemblies 50 and sucker rods 52. The lip 38 functions as a hold down for the downhole pump assembly 50 such that the downhole pump assembly 50 remains seated within the seating nipple 20 during both upstrokes and downstrokes.

C. Gas Eliminators.

As shown in FIGS. 2 and 3, the seating nipple 20 includes a plurality of gas eliminators 40*a*, 40*b*, 40*c*, 40*d*, 42*a*, 42*b*, 42*c*, 42*d*, 44*a*, 44*b*, 44*c*, 44*d* which function to prevent gas 56 build-up within the downhole pump assembly 50 by providing a path for any such gasses 56 to be expelled from within the seating nipple 20. The figures illustrate an embodiment which includes twelve such gas eliminators 40*a*, 40*b*, 40*c*, 40*d*, 42*a*, 42*b*, 42*c*, 42*d*, 44*a*, 44*b*, 44*c*, 44*d* arranged in four columns of three gas eliminators 40*a*, 40*b*, 40*c*, 40*d*, 42*a*, 42*b*, 42*c*, 42*d*, 44*a*, 44*b*, 44*c*, 44*d* each. It should be appreciated, however, that more or less gas eliminators 40*a*, 40*b*, 40*c*, 40*d*, 42*a*, 42*b*, 42*c*, 42*d*, 44*a*, 44*b*, 44*c*, 44*d* may be utilized in different embodiments.

The arrangement and positioning of the gas eliminators 40*a*, 40*b*, 40*c*, 40*d*, 42*a*, 42*b*, 42*c*, 42*d*, 44*a*, 44*b*, 44*c*, 44*d* may vary in different embodiments. In the exemplary embodiment best shown in FIGS. 2 and 3, it can be seen that four upper gas eliminators 40*a*, 40*b*, 40*c*, 40*d* are positioned at equal intervals around the outer circumference 23 of the seating nipple 20. Similarly, four central gas eliminators 42*a*, 42*b*, 42*c*, 42*d* are positioned beneath the upper gas eliminators 40*a*, 40*b*, 40*c*, 40*d* and positioned at equal intervals around the outer circumference of the seating nipple 20. Finally, four lower gas eliminators 44*a*, 44*b*, 44*c*, 44*d* are positioned beneath the central gas eliminators 42*a*, 42*b*, 42*c*, 42*d* and positioned at equal intervals around the outer circumference of the seating nipple 20.

It should be appreciated that the gas eliminators 40*a*, 40*b*, 40*c*, 40*d*, 42*a*, 42*b*, 42*c*, 42*d*, 44*a*, 44*b*, 44*c*, 44*d* may be shifted into any configuration or pattern on the seating nipple 20 to achieve similar gas eliminating conditions or benefits. Further, additional gas eliminators 40*a*, 40*b*, 40*c*, 40*d*, 42*a*, 42*b*, 42*c*, 42*d*, 44*a*, 44*b*, 44*c*, 44*d* may be added to the seating nipple 20, which can be comprised of any size opening to allow the escape of trapped gasses 56. The arrangement and positioning of the gas eliminators 40*a*, 40*b*, 40*c*, 40*d*, 42*a*, 42*b*, 42*c*, 42*d*, 44*a*, 44*b*, 44*c*, 44*d* shown in the figures provides maximum strength to the body of the seating nipple 20.

Continuing to reference FIGS. 2 and 3, it can be seen that the first upper gas eliminator 40*a* is positioned opposite to and aligned with the third upper gas eliminator 40*c*. The second upper gas eliminator 40*b* is positioned opposite to and aligned with the fourth upper gas eliminator 40*d*. The first central gas eliminator 42*a* is positioned opposite to and aligned with the third central gas eliminator 42*c*. The second central gas eliminator 42*b* is positioned opposite to and aligned with the fourth central gas eliminator 42*b*. The first lower gas eliminator 44*a* is positioned opposite to and aligned with the third lower gas eliminator 44*c*. The second lower gas eliminator 44*b* is positioned opposite to and aligned with the fourth lower gas eliminator 44*d*.

As shown in FIGS. 6-8, the upper gas eliminators 40*a*, 40*b*, 40*c*, 40*d* are each positioned underneath the beveled edge 36 of the seating nipple 20. The central gas eliminators 42*a*, 42*b*, 42*c*, 42*d* are positioned underneath the upper gas eliminators 40*a*, 40*b*, 40*c*, 40*d* and above the locking lip 38 of the seating nipple 20. The lower gas eliminators 44*a*, 44*b*, 44*c*, 44*d* are positioned underneath the central gas eliminators 42*a*, 42*b*, 42*c*, 42*d* and below the locking lip 38 of the seating nipple 20.

The use of such gas eliminators 40*a*, 40*b*, 40*c*, 40*d*, 42*a*, 42*b*, 42*c*, 42*d*, 44*a*, 44*b*, 44*c*, 44*d* stop or eliminates gas build-up which can significantly hamper operation of a downhole pump assembly 50. In previous designs of seating nipples 20, gas has been allowed to build up within the seating nipple 20 at various locations. The seating nipple 20 described herein does not allow for any such gas buildup, with any gasses being expelled through the gas eliminators 40*a*, 40*b*, 40*c*, 40*d*, 42*a*, 42*b*, 42*c*, 42*d*, 44*a*, 44*b*, 44*c*, 44*d* as discussed herein.

The area between the beveled edge 36 and locking lip 38 can allow for the accumulation of gasses 56 during operation of the downhole pump assembly 50. Thus, the positioning of the upper gas eliminators 40*a*, 40*b*, 40*c*, 40*d* and central gas eliminators 42*a*, 42*b*, 42*c*, 42*d* between the beveled edge 36 and the locking lip 38 of the seating nipple 20 functions to expel such gasses 56 during operation of the downhole pump assembly 50 from an area in which the gasses 56 would otherwise collect, thus preventing gas locking of the downhole pump assembly 50.

As best shown in FIGS. 7 and 8, each of the gas eliminators 40*a*, 40*b*, 40*c*, 40*d*, 42*a*, 42*b*, 42*c*, 42*d*, 44*a*, 44*b*, 44*c*, 44*d* is generally comprised of an angled or slanted opening which extends between the channel 30 of the seating nipple 20 and its outer circumference 23, thus creating a path through which gasses may exit the seating nipple 20 rather than building up therein as typically occurs in previous systems. As discussed herein, the shape, size, positioning, and orientation of the gas eliminators 40*a*, 40*b*, 40*c*, 40*d*, 42*a*, 42*b*, 42*c*, 42*d*, 44*a*, 44*b*, 44*c*, 44*d* may vary in different embodiments, and thus should not be construed as limited by the exemplary embodiments shown in the figures.

With reference to FIGS. 7 and 8, it can be seen that a plurality of upper gas eliminators 40*a*, 40*b*, 40*c*, 40*d* are positioned with their respective inlets being just below the beveled edge 36 within the central portion 37 of the channel 30. In the exemplary embodiment shown in the figures, four upper gas eliminators 40*a*, 40*b*, 40*c*, 40*d* are shown, with a first upper gas eliminator 40*a* positioned on the first side 26*a* of the seating nipple 20, a second upper gas eliminator 40*b* positioned on the second side 26*b* of the seating nipple 20, a third upper gas eliminator 40*c* positioned on the third side 26*c* of the seating nipple 20, and a fourth upper gas eliminator 40*d* positioned on the fourth side 26*d* of the seating nipple 20.

Each of the upper gas eliminators 40*a*, 40*b*, 40*c*, 40*d* is illustrated as extending through the seating nipple 20, between its outer circumference 23 and the inner surface 32 of the channel 30, at an angle. Thus, the inlet of each upper gas eliminator 40*a*, 40*b*, 40*c*, 40*d* is comprised of an opening in the inner surface 32 of the channel 30 and the outlet of each upper gas eliminator 40*a*, 40*b*, 40*c*, 40*d* is comprised of an opening in the outer circumference 23 of the seating nipple 20. More specifically, the upper gas eliminators 40*a*, 40*b*, 40*c*, 40*d* are illustrated as being angled upwardly from their inlets on the inner surface 32 of the channel 30 to their outlets on the outer circumference 23 of the seating nipple 20. Thus, each of the upper gas eliminators 40*a*, 40*b*, 40*c*, 40*d* is shown with an inlet which is lower than its outlet.

The figures illustrate an exemplary embodiment in which the upper gas eliminators 40*a*, 40*b*, 40*c*, 40*d* are angled upwardly from inlet to outlet at a 45 degree angle. It should be appreciated, however, that other angles may be utilized. In some embodiments, the angle by which the upper gas eliminators 40*a*, 40*b*, 40*c*, 40*d* extend with respect to an axis extending between the upper and lower ends 21, 22 of the seating nipple 20 may be greater than, equal to, or less than 45 degrees.

Continuing to reference FIGS. 7 and 8, it can be seen that a plurality of central gas eliminators 42*a*, 42*b*, 42*c*, 42*d* are positioned with their respective inlets being centrally located along the length of the central portion 37 of the channel 30. Each of the central gas eliminators 42*a*, 42*b*, 42*c*, 42*d* is thus positioned underneath each of the upper gas eliminators 40*a*, 40*b*, 40*c*, 40*d*.

In the exemplary embodiment shown in the figures, four central gas eliminators 42*a*, 42*b*, 42*c*, 42*d* are shown, with a first central gas eliminator 42*a* positioned on the first side 26*a* of the seating nipple 20, a second central gas eliminator 42*b* positioned on the second side 26*b* of the seating nipple 20, a third central gas eliminator 42*c* positioned on the third side 26*c* of the seating nipple 20, and a fourth central gas eliminator 42*d* positioned on the fourth side 26*d* of the seating nipple 20. As shown in FIGS. 2 and 3, the first central gas eliminator 42*a* is aligned with and beneath the first upper gas eliminator 40*a*, the second central gas eliminator 42*b* is aligned with and beneath the second upper gas eliminator 40*b*, the third central gas eliminator 42*c* is aligned with a beneath the third upper gas eliminator 40*c*, and the fourth central gas eliminator 42*d* is aligned with and beneath the fourth upper gas eliminator 40*d*.

Each of the central gas eliminators 42*a*, 42*b*, 42*c*, 42*d* is illustrated as extending through the seating nipple 20, between its outer circumference 23 and the inner surface 32 of the channel 30, at an angle. Thus, the inlet of each central gas eliminator 42*a*, 42*b*, 42*c*, 42*d* is comprised of an opening in the inner surface 32 of the channel 30 and the outlet of each central gas eliminator 42*a*, 42*b*, 42*c*, 42*d* is comprised of an opening in the outer circumference 23 of the seating nipple 20. More specifically, the central gas eliminators 42*a*, 42*b*, 42*c*, 42*d* are illustrated as being angled upwardly from their inlets on the inner surface 32 of the channel 30 to their outlets on the outer circumference 23 of the seating nipple 20. Thus, each of the central gas eliminators 42*a*, 42*b*, 42*c*, 42*d* is shown with an inlet which is lower than its outlet.

The figures illustrate an exemplary embodiment in which the central gas eliminators 42*a*, 42*b*, 42*c*, 42*d* are angled upwardly from inlet to outlet at a 45 degree angle. It should be appreciated, however, that other angles may be utilized.

In some embodiments, the angle by which the central gas eliminators 42*a*, 42*b*, 42*c*, 42*d* extend with respect to an axis extending between the upper and lower ends 21, 22 of the seating nipple 20 may be greater than, equal to, or less than 45 degrees.

Continuing to reference FIGS. 7 and 8, it can be seen that a plurality of lower gas eliminators 44*a*, 44*b*, 44*c*, 44*d* are positioned with their respective inlets being positioned just underneath the locking lip 38 of the seating nipple 20. Each of the lower gas eliminators 44*a*, 44*b*, 44*c*, 44*d* is thus positioned underneath each of the central gas eliminators 42*a*, 42*b*, 42*c*, 42*d*.

In the exemplary embodiment shown in the figures, four lower gas eliminators 44*a*, 44*b*, 44*c*, 44*d* are shown, with a first lower gas eliminator 44*a* positioned on the first side 26*a* of the seating nipple 20, a second lower gas eliminator 44*b* positioned on the second side 26*b* of the seating nipple 20, a third lower gas eliminator 44*c* positioned on the third side 26*c* of the seating nipple 20, and a fourth lower gas eliminator 44*d* positioned on the fourth side 26*d* of the seating nipple 20. As shown in FIGS. 2 and 3, the first lower gas eliminator 44*a* is aligned with and beneath the first central gas eliminator 42*a*, the second lower gas eliminator 44*b* is aligned with and beneath the second central gas eliminator 42*b*, the third lower gas eliminator 44*c* is aligned with a beneath the third central gas eliminator 42*c*, and the fourth lower gas eliminator 44*d* is aligned with and beneath the fourth central gas eliminator 42*d*.

Each of the lower gas eliminators 44*a*, 44*b*, 44*c*, 44*d* is illustrated as extending through the seating nipple 20, between its outer circumference 23 and the inner surface 32 of the channel 30, at an angle. Thus, the inlet of each lower gas eliminator 44*a*, 44*b*, 44*c*, 44*d* is comprised of an opening in the inner surface 32 of the channel 30 and the outlet of each lower gas eliminator 44*a*, 44*b*, 44*c*, 44*d* is comprised of an opening in the outer circumference 23 of the seating nipple 20. More specifically, the lower gas eliminators 44*a*, 44*b*, 44*c*, 44*d* are illustrated as being angled upwardly from their inlets on the inner surface 32 of the channel 30 to their outlets on the outer circumference 23 of the seating nipple 20. Thus, each of the lower gas eliminators 44*a*, 44*b*, 44*c*, 44*d* is shown with an inlet which is lower than its outlet.

The figures illustrate an exemplary embodiment in which the lower gas eliminators 44*a*, 44*b*, 44*c*, 44*d* are angled upwardly from inlet to outlet at a 45 degree angle. It should be appreciated, however, that other angles may be utilized. In some embodiments, the angle by which the lower gas eliminators 44*a*, 44*b*, 44*c*, 44*d* extend with respect to an axis extending between the upper and lower ends 21, 22 of the seating nipple 20 may be greater than, equal to, or less than 45 degrees.

The function of each of the gas eliminators 40*a*, 40*b*, 40*c*, 40*d*, 42*a*, 42*b*, 42*c*, 42*d*, 44*a*, 44*b*, 44*c*, 44*d* is to expel gas which is entrained in fluids 55 being pumped by the downhole pump assembly 50. In previous systems, such gas has been known to build up either inside or beneath conventional seating nipples 20 in a manner which negatively impacts operation of the downhole pump assembly 50. By utilizing angled openings to function as gas eliminators 40*a*, 40*b*, 40*c*, 40*d*, 42*a*, 42*b*, 42*c*, 42*d*, 44*a*, 44*b*, 44*c*, 44*d*, the systems and methods described herein can reduce or eliminate entirely such gas build-ups and thus significantly improve operation of any downhole pump assembly 50 with which the seating nipple 20 disclosed herein is utilized.

The manner by which the gas eliminators 40*a*, 40*b*, 40*c*, 40*d*, 42*a*, 42*b*, 42*c*, 42*d*, 44*a*, 44*b*, 44*c*, 44*d* are formed within the seating nipple 20 may vary in different embodiments. In a preferred embodiment, each of the gas eliminators 40*a*, 40*b*, 40*c*, 40*d*, 42*a*, 42*b*, 42*c*, 42*d*, 44*a*, 44*b*, 44*c*, 44*d* may be formed by drilling downwardly from the outer circumference 23 of the seating nipple 20 until the opening penetrates the inner surface 32 of the channel 30. The angle by which the openings are drilled may vary in different embodiments, with a preferred embodiment comprising a 45 degree angle with respect to an axis extending between the upper and lower ends 21, 22 of the seating nipple 20.

It should be appreciated that the number of gas eliminators 40*a*, 40*b*, 40*c*, 40*d*, 42*a*, 42*b*, 42*c*, 42*d*, 44*a*, 44*b*, 44*c*, 44*d* utilized in the seating nipple 20 may vary in different embodiments. Thus, more or less gas eliminators 40*a*, 40*b*, 40*c*, 40*d*, 42*a*, 42*b*, 42*c*, 42*d*, 44*a*, 44*b*, 44*c*, 44*d* may be utilized than are shown in the exemplary embodiments shown in the figures. Further, the positioning of the gas eliminators 40*a*, 40*b*, 40*c*, 40*d*, 42*a*, 42*b*, 42*c*, 42*d*, 44*a*, 44*b*, 44*c*, 44*d*, in which each of the first gas eliminators 40*a*, 42*a*, 44*a* are linearly aligned on the first side 26*a* of the seating nipple 20, each of the second gas eliminators 40*b*, 42*b*, 44*b* are linearly aligned on the second side 26*b* of the seating nipple 20, each of the third gas eliminators 40*c*, 42*c*, 44*c* are linearly aligned on the third side 26*c* of the seating nipple 20, and each of the fourth gas eliminators 40*d*, 42*d*, 44*d* are linearly aligned on the fourth side 26*d* of the seating nipple 20 are not meant to be limiting in scope. Various other positions for the various gas eliminators 40*a*, 40*b*, 40*c*, 40*d*, 42*a*, 42*b*, 42*c*, 42*d*, 44*a*, 44*b*, 44*c*, 44*d* may be utilized in different embodiments, particularly to suit different types of downhole pump assemblies 50 or different types of mined substances.

It should also be appreciated that the diameter of each of the gas eliminators 40*a*, 40*b*, 40*c*, 40*d*, 42*a*, 42*b*, 42*c*, 42*d*, 44*a*, 44*b*, 44*c*, 44*d* may vary in different embodiments. The figures illustrate that each of the gas eliminators 40*a*, 40*b*, 40*c*, 40*d*, 42*a*, 42*b*, 42*c*, 42*d*, 44*a*, 44*b*, 44*c*, 44*d* comprises the same diameter, but in other embodiments the diameters of some or all of the gas eliminators 40*a*, 40*b*, 40*c*, 40*d*, 42*a*, 42*b*, 42*c*, 42*d*, 44*a*, 44*b*, 44*c*, 44*d* may vary with respect to each other.

While the figures illustrate that each of the gas eliminators 40*a*, 40*b*, 40*c*, 40*d*, 42*a*, 42*b*, 42*c*, 42*d*, 44*a*, 44*b*, 44*c*, 44*d* is angled upwardly from its inlet to its outlet, there are certain embodiments in which each of the gas eliminators 40*a*, 40*b*, 40*c*, 40*d*, 42*a*, 42*b*, 42*c*, 42*d*, 44*a*, 44*b*, 44*c*, 44*d* are instead angled downwardly from inlet to outlet. For example, when mining fluids 55 with embedded particulate materials such as sand, it is preferable to instead angle each of the gas eliminators 40*a*, 40*b*, 40*c*, 40*d*, 42*a*, 42*b*, 42*c*, 42*d*, 44*a*, 44*b*, 44*c*, 44*d* downwardly from inlet to outlet. Such a configuration reduces the likelihood that grains or debris of any such particulate materials will roll up through the gas eliminators 40*a*, 40*b*, 40*c*, 40*d*, 42*a*, 42*b*, 42*c*, 42*d*, 44*a*, 44*b*, 44*c*, 44*d*.

D. Downhole Pump Assembly and Operation Thereof.

The systems and methods described herein, including the seating nipple 20, may be utilized with a wide range of downhole pump assemblies 50. FIG. 9 illustrates one exemplary embodiment of a conventional downhole pump assembly 50 which has been outfitted with the seating nipple 20. It should be appreciated that the seating nipple 20 would function with various other types of downhole pump assemblies 50. Thus, the following description of an exemplary downhole pump assembly 50 should not be construed as limiting in scope.

In the exemplary embodiment of a downhole pump assembly 50 shown in FIG. 9, it can be seen that a casing 62 extends down through a drilled hole in a ground surface. A sucker rod 52 is shown extending through the casing 62 and into a downhole pump 51. The sucker rod 52 is generally positioned between the surface and downhole components of the downhole pump assembly 50. The sucker rod 52 may include multiple independent segments which are interconnected together to form a unitary rod. The use of multiple interconnected segments allows for the sucker rod 52 to accommodate different depths of well holes.

The sucker rod 52 operates within a casing 62 of the downhole pump assembly 50, with the casing 62 extending through the length of the well hole. The distal end of the sucker rod 52 may include a plunger 53 such as shown in FIG. 9 which functions with the downhole pump 51 to draw fluids 55 up through the casing 62 to be extracted from the well hole by the downhole pump assembly 50. The plunger 53 reciprocates within the downhole pump 51 in upstrokes and downstrokes. The seating nipple 20 is utilized to hold the downhole pump assembly 50, including the downhole pump 51, in a fixed position during the upstrokes and downstrokes of the plunger 53.

Continuing to reference FIG. 9, it can be seen that multiple inlet openings 54 are formed within the casing 62 through which the mined substance, such as water or oil, is drawn into the casing 62. The number of inlet openings 54 may vary in different embodiments of a downhole pump assembly 50. The upstroke of the sucker rod 52 functions to draw the mined substances through the inlet openings 54. The inlet openings 54 are thus generally positioned beneath the top level of the mined substance underground.

A valve 57 such as a ball valve as shown in FIG. 9 is utilized in combination with a seal ring to regulate flow of the mined substance during the upstrokes and downstrokes of the sucker rod 52 and plunger 53. FIG. 9 illustrates the sucker rod 52 and plunger 53 in the upstroke position, with dashed lines representing the positioning of the sucker rod 52 and plunger 53 in the downstroke position. As can be seen, the valve 57 is raised to release from the seal ring in the upstroke position, and lowered to close the seal ring in the downstroke position.

On the upstroke of the sucker rod 52 and plunger 53, fluid 55 is drawn from a reservoir and into the casing 62 through casing perforations 63. The fluid 55 is then drawn into the downhole pump assembly 50 via inlet openings 54 which are positioned just underneath the lower end 22 of the seating nipple 20. The fluid 55 then traverses through the channel 30 of the seating nipple 20 and up through the casing 62 to be retrieved above-ground.

As the fluid 55 passes through the seating nipple 20, gasses 56 entrained in the fluid 55, which would previously have collected within the seating nipple 20 in previous, convention designs, is instead drawn out of the seating nipple 20 and into the casing 62 by the gas eliminators 40*a*, 40*b*, 40*c*, 40*d*, 42*a*, 42*b*, 42*c*, 42*d*, 44*a*, 44*b*, 44*c*, 44*d*. By expelling the gasses 56 rather than allowing them to collect in the seating nipple 20, the collection of such gasses 56 within or below the seating nipple 20 may be prevented, thus significantly reducing the chance that the downhole pump assembly 50 will be gas locked.

In use, a hole is first drilled into the ground to reach a reservoir and the downhole pump assembly 50 is installed. A tubing string 60 and casing 62 are positioned within the hole, with casing perforations 63 being positioned within the reservoir of fluid 55 to draw the fluid 55 into the casing 62. The seating nipple 20 is installed and secured within the casing 62 by use of a plurality of tubing collars 58*a*, 58*b*, 58*c*, 58*d*, 58*e*, 58*f*.

In the embodiment shown in FIG. 9, a bull plug 61 is positioned above the casing perforations 63 and held in place by a tubing collar 58*f*. A joint 59*b* may be positioned above the bull plug 61 and secured with a tubing collar 58*e*. An additional joint 59*a* may be positioned above the previous joint 59*b* and secured with an additional tubing collar 58*d*. The joints 59*a*, 59*b* and bull plug 61 function as a mud anchor. The inlet openings 54 are positioned just above this tubing collar 58*d*.

An additional tubing collar 58*c* is positioned above the inlet openings 54 to which the lower end 22 of the seating nipple 20 may be attached such as shown in FIG. 9. Generally, the lower connector 29 of the seating nipple 20 may be utilized to secure the lower end 22 of the seating nipple 20 in position to hold down the downhole pump assembly 50. An additional tubing collar 58*b* is secured to the upper end 21 of the seating nipple 20, such as by use of the upper connector 58. A tubing anchor 65 is positioned above this tubing collar 58*b*, and secured by an additional tubing collar 58*b* above the tubing anchor 65. The seating nipple 20 is then installed and in position, awaiting operation of the downhole pump assembly 50 during which the sucker rod 52 and plunger 53 will reciprocate between upstrokes and downstrokes within the seating nipple 20.

As the sucker rod 52 and plunger 53 are on the upstroke, fluid 55 will be drawn from the reservoir through the inlet openings 54 into the casing 62. The fluid 55 will further be drawn up through the seating nipple 20. Entrained gasses 56 within the fluid 55 will be expelled through the gas eliminators 40*a*, 40*b*, 40*c*, 40*d*, 42*a*, 42*b*, 42*c*, 42*d*, 44*a*, 44*b*, 44*c*, 44*d* rather than collecting within the seating nipple 20, thus preventing gas locking which can inhibit the mining operation. The angled orientation of the gas eliminators 40*a*, 40*b*, 40*c*, 40*d*, 42*a*, 42*b*, 42*c*, 42*d*, 44*a*, 44*b*, 44*c*, 44*d* aids in allowing the gasses 56 to exit the seating nipple 20 and into the casing 62, where the gasses 56 may bubble up to the surface. As shown in FIG. 9, the gasses 56 exit the seating nipple 20 and rise within the casing 62 without collecting within or below the seating nipple 20, which can cause gas locking conditions.

The seating nipple 20 functions to "seat" the downhole pump assembly 50 at the bottom of the string of the sucker rod 52 while the sucker rod 52 reciprocates between upstrokes and downstrokes. The tubing collars 58*a*, 58*b*, 58*c*, 58*d*, 58*e*, 58*f* hold the seating nipple 20 in place, with the bull plug 61 functioning to maintain the requisite pressure necessary for pumping operations. As the sucker rod 52 reciprocates between its upstrokes and downstrokes, the seating nipple 20 holds the downhole pump assembly 50 in place, functioning as an anchor.

As fluid 55 is drawn up through the downhole pump assembly 50 on the upstroke of the sucker rod 52, the fluid 55 will be drawn through the seating nipple 20 from its lower end 22 to its upper end 21. Any gasses 56 entrained within the fluid 55 are expelled from the seating nipple 20 and into the casing 62 by operation of the gas eliminators 40*a*, 40*b*, 40*c*, 40*d*, 42*a*, 42*b*, 42*c*, 42*d*, 44*a*, 44*b*, 44*c*, 44*d*.

The gas eliminators 40*a*, 40*b*, 40*c*, 40*d*, 42*a*, 42*b*, 42*c*, 42*d*, 44*a*, 44*b*, 44*c*, 44*d* are angled to effectuate the elimination of such gasses 56 from within the seating nipple 20, with the gasses 56 be forced out of the seating nipple 20 by the gas eliminators 40*a*, 40*b*, 40*c*, 40*d*, 42*a*, 42*b*, 42*c*, 42*d*, 44*a*, 44*b*, 44*c*, 44*d*. The gasses 56 will then pass into the casing 62 so as to bubble up to the surface. As the gasses 56 are not permitted to collect within or below the seating nipple 20 during the upstroke or downstroke of the sucker rod 52, gas locking is prevented. The efficiency of the downhole pump assembly 50 is thus greatly improved, as gas locking can lead to significant amounts of downtime and seriously inhibit operation of the downhole pump assembly 50.

Unless otherwise defined, all technical and scientific terms used herein have the same meaning as commonly understood by one of ordinary skill in the art to which this invention belongs. Although methods and materials similar to or equivalent to those described herein can be used in the practice or testing of the downhole pump gas eliminating seating nipple system, suitable methods and materials are described above. All publications, patent applications, patents, and other references mentioned herein are incorporated by reference in their entirety to the extent allowed by applicable law and regulations. The downhole pump gas eliminating seating nipple system may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

What is claimed is:

1. A seating nipple for a downhole pump, comprising:

a body comprising an upper end, a lower end, an upper opening, a lower opening, and an outer circumference;

a channel extending through the body between the upper opening and the lower opening, wherein the channel comprises an inner surface;

a beveled edge formed on the inner surface of the channel below the upper end of the body;

a locking lip formed on the inner surface of the channel above the lower end of the body;

a plurality of upper gas eliminators extending from the inner surface of the channel to the outer circumference of the body, wherein each of the plurality of upper gas eliminators is positioned below the beveled edge, wherein each of the plurality of upper gas eliminators comprises an upper gas eliminator inlet and an upper gas eliminator outlet, wherein each of the plurality of upper gas eliminators is angled upwardly between the upper gas eliminator inlet and the upper gas eliminator outlet; and a plurality of lower gas eliminators extending from the inner surface of the channel to the outer circumference of the body, wherein each of the plurality of lower gas eliminators are positioned below the locking lip, wherein each of the plurality of lower gas eliminators comprises a lower gas eliminator inlet and a lower gas eliminator outlet, wherein each of the plurality of lower gas eliminators is angled upwardly between the lower gas eliminator inlet and the lower gas eliminator outlet, and wherein each of the plurality of lower gas eliminators is vertically aligned with one of the plurality of upper gas eliminators.

2. The seating nipple for a downhole pump of claim 1, wherein the body is comprised of a circular cross-section.

3. The seating nipple for a downhole pump of claim 2, wherein the body is comprised of a cylindrical shape.

4. The seating nipple for a downhole pump of claim 1, wherein the plurality of upper gas eliminators are comprised of a first upper gas eliminator on a first side of the seating nipple, a second upper gas eliminator on a second side of the seating nipple, a third upper gas eliminator on a third side of the seating nipple, and a fourth upper gas eliminator on a fourth side of the seating nipple.

5. The seating nipple for a downhole pump of claim 4, wherein the first upper gas eliminator is horizontally aligned with the third upper gas eliminator and wherein the second upper gas eliminator is horizontally aligned with the fourth upper gas eliminator.

6. The seating nipple for a downhole pump of claim 1, wherein each of the plurality of upper gas eliminators extends upwardly at a 45 degree angle between the upper gas eliminator inlet and the upper gas eliminator outlet.

7. The seating nipple for a downhole pump of claim 1, wherein the plurality of lower gas eliminators are comprised of a first lower gas eliminator on a first side of the seating nipple, a second lower gas eliminator on a second side of the seating nipple, a third lower gas eliminator on a third side of the seating nipple, and a fourth lower gas eliminator on a fourth side of the seating nipple.

8. The seating nipple for a downhole pump of claim 7, wherein the first lower gas eliminator is horizontally aligned with the third lower gas eliminator and wherein the second lower gas eliminator is horizontally aligned with the fourth lower gas eliminator.

9. The seating nipple for a downhole pump of claim 1, wherein each of the plurality of lower gas eliminators extends upwardly at a 45 degree angle between the lower gas eliminator inlet and the lower gas eliminator outlet.

10. The seating nipple for a downhole pump of claim 1, further comprising a plurality of central gas eliminators extending from the inner surface of the channel to the outer circumference of the body, wherein each of the plurality of central gas eliminators are positioned between the locking lip and the plurality of upper gas eliminators, wherein each of the plurality of central gas eliminators comprises a central gas eliminator inlet and a central gas eliminator outlet, wherein each of the plurality of central gas eliminators is angled upwardly between the central gas eliminator inlet and the central gas eliminator outlet.

11. The seating nipple for a downhole pump of claim 10, wherein each of the plurality of central gas eliminators is vertically aligned with one of the plurality of upper gas eliminators and one of the plurality of lower gas eliminators.

12. The seating nipple for a downhole pump of claim 10, wherein the plurality of central gas eliminators are comprised of a first central gas eliminator on a first side of the seating nipple, a second central gas eliminator on a second side of the seating nipple, a third central gas eliminator on a third side of the seating nipple, and a fourth central gas eliminator on a fourth side of the seating nipple.

13. The seating nipple for a downhole pump of claim 12, wherein the first central gas eliminator is horizontally aligned with the third central gas eliminator and wherein the second central gas eliminator is horizontally aligned with the fourth central gas eliminator.

14. The seating nipple for a downhole pump of claim 10, wherein each of the plurality of central gas eliminators extends upwardly at a 45 degree angle between the central gas eliminator inlet and the central gas eliminator outlet.

15. The seating nipple for a downhole pump of claim 1, wherein the upper end of the body comprises an upper connector and wherein the lower end of the body comprises a lower connector.

16. The seating nipple for a downhole pump of claim 15, wherein the upper connector and the lower connector are each comprised of a threaded connector.

17. The seating nipple for a downhole pump of claim 16, wherein the upper connector is comprised of a first male threaded connector and wherein the lower connector is comprised of a second male threaded connector.

18. A seating nipple for a downhole pump, comprising:

a body comprising an upper end, a lower end, an upper opening, a lower opening, and an outer circumference, wherein the body comprises an upper connector and a lower connector;

a channel extending through the body between the upper opening and the lower opening, wherein the channel comprises an inner surface;

a beveled edge formed on the inner surface of the channel below the upper end of the body;

a locking lip formed on the inner surface of the channel above the lower end of the body;

a plurality of upper gas eliminators extending from the inner surface of the channel to the outer circumference of the body, wherein each of the plurality of upper gas eliminators is positioned below the beveled edge, wherein each of the plurality of upper gas eliminators comprises an upper gas eliminator inlet and an upper gas eliminator outlet, wherein each of the plurality of upper gas eliminators is angled upwardly between the upper gas eliminator inlet and the upper gas eliminator outlet;

a plurality of central gas eliminators extending from the inner surface of the channel to the outer circumference of the body, wherein each of the plurality of central gas eliminators are positioned between the locking lip and the plurality of upper gas eliminators, wherein each of the plurality of central gas eliminators comprises a central gas eliminator inlet and a central gas eliminator outlet, wherein each of the plurality of central gas eliminators is angled upwardly between the central gas eliminator inlet and the central gas eliminator outlet; and a plurality of lower gas eliminators extending from the inner surface of the channel to the outer circumference of the body, wherein each of the plurality of lower gas eliminators are positioned below the locking lip, wherein each of the plurality of lower gas eliminators comprises a lower gas eliminator inlet and a lower gas eliminator outlet, wherein each of the plurality of lower gas eliminators is angled upwardly between the lower gas eliminator inlet and the lower gas eliminator outlet.

19. A seating nipple for a downhole pump, comprising:

a body comprising an upper end, a lower end, an upper opening, a lower opening, and an outer circumference;

a channel extending through the body between the upper opening and the lower opening, wherein the channel comprises an inner surface;

a beveled edge formed on the inner surface of the channel below the upper end of the body;

a locking lip formed on the inner surface of the channel above the lower end of the body;

a plurality of upper gas eliminators extending from the inner surface of the channel to the outer circumference of the body, wherein each of the plurality of upper gas eliminators is positioned below the beveled edge, wherein each of the plurality of upper gas eliminators comprises an upper gas eliminator inlet and an upper gas eliminator outlet, wherein each of the plurality of upper gas eliminators is angled upwardly between the upper gas eliminator inlet and the upper gas eliminator outlet;

a plurality of lower gas eliminators extending from the inner surface of the channel to the outer circumference of the body, wherein each of the plurality of lower gas eliminators are positioned below the locking lip, wherein each of the plurality of lower gas eliminators comprises a lower gas eliminator inlet and a lower gas eliminator outlet, wherein each of the plurality of lower gas eliminators is angled upwardly between the lower gas eliminator inlet and the lower gas eliminator outlet; and a plurality of central gas eliminators extending from the inner surface of the channel to the outer circumference of the body, wherein each of the plurality of central gas eliminators are positioned between the locking lip and the plurality of upper gas eliminators, wherein each of the plurality of central gas eliminators comprises a central gas eliminator inlet and a central gas eliminator outlet, wherein each of the plurality of central gas eliminators is angled upwardly between the central gas eliminator inlet and the central gas eliminator outlet.

* * * * *